US005929736A

United States Patent [19]

Sakamaki et al.

[11] Patent Number: 5,929,736

[45] Date of Patent: Jul. 27, 1999

[54] ENGINE IGNITING COIL DEVICE AND METHOD OF WINDING AN IGNITION COIL

[75] Inventors: Makoto Sakamaki; Toshiyuki Shinozawa; Yoshiharu Saito, all of Tsurugashima, Japan

[73] Assignee: Toyo Denso Kabushiki Kaisha, Tokyo, Japan

[21] Appl. No.: 08/919,932

[22] Filed: Aug. 28, 1997

[30] Foreign Application Priority Data

| | | | |
|---|---|---|---|
| Aug. 31, 1996 | [JP] | Japan | 8-266506 |
| Aug. 31, 1996 | [JP] | Japan | 8-266507 |
| Aug. 31, 1996 | [JP] | Japan | 8-266508 |

[51] Int. Cl.[6] ..... H01F 27/02; H01F 27/28

[52] U.S. Cl. ..... 336/96; 336/225; 336/190; 336/222

[58] Field of Search ..... 336/190, 222, 336/225, 198, 96

[56] References Cited

U.S. PATENT DOCUMENTS

| | | | |
|---|---|---|---|
| 2,916,711 | 12/1959 | Gillen | 336/222 |
| 4,988,055 | 1/1991 | Sakai et al. | 242/159 |
| 5,632,259 | 5/1997 | Konda et al. | 123/634 |
| 5,736,917 | 4/1998 | Kawano et al. | 226/90 |
| 5,767,758 | 6/1998 | Sakamaki | 336/107 |

FOREIGN PATENT DOCUMENTS

| | | | |
|---|---|---|---|
| 196 451 | 3/1938 | European Pat. Off. | 336/190 |
| 55-36907 | 3/1980 | Japan | 336/231 |
| 60-107813 | 6/1985 | Japan | 336/90 |

*Primary Examiner*—Michael L. Gellner
*Assistant Examiner*—Anh Mai
*Attorney, Agent, or Firm*—Lyon & Lyon LLP

[57] ABSTRACT

In an engine igniting coil device comprising an ignition coil assembly potted integrally in a coil case by injecting melted insulating resin, a secondary coil is formed on a coil bobbin by bank winding an element wire in layers of wire turns one over another at a certain bank angle in an axial direction on the bobbin and by slope-winding of layers on the end portion of the bobbin by tapering the coil (by reducing the number of layers therein) in the winding direction. This allows setting a dielectric strength of interlayer insulation of the secondary coil according to a potential distribution therebetween, which is secured by forming an insulation resin layer of a reduced thickness between the coil case and the secondary coil of the secondary coil bobbin, thus realizing a compact engine-igniting coil device.

6 Claims, 5 Drawing Sheets

ENGINE IGNITING COIL DEVICE AND METHOD OF WINDING AN IGNITION COIL

BACKGROUND OF THE INVENTION

The present invention relates to an engine igniting coil device and a method of winding a secondary coil of the device.

A secondary coil in a conventional engine ignition coil device is wound axially on a coil bobbin in such a manner that an element wire is wound in layers around sections of the coil bobbin, which sections are separated by a plurality of intermediate ribs and both end flanges. The coil bobbin has an increased number of sections separated by thick-wall ribs to assure necessary dielectric strength of coil turns laid in each section. Consequently, the conventional engine coil device using the above-mentioned type coil bobbin has a large size.

Japanese laid-open patent No. 60-107813 is directed to a compact engine ignition coil device which, as shown in FIG. 8, uses a no-ribbed coil bobbin 8' on which a coil wire 71 is wound axially in bank layers at a specified bank angle θ by a so-called bank-winding method permitting the setting of the dielectric strength of the coil interlayer insulation at a low value.

FIG. 10 depicts a conventional bank winding method by which a coil wire 29 being fed from a nozzle 30 reciprocating in the axial direction for a distance of a specified width w' corresponding to bank length l is wound axially in layers of wire turns one by one at a specified bank angle θ on a coil bobbin 8 which is rotated about its axis and, at the same time, moves axially.

The conventional bank winding method, however, involves a problem that the reciprocal movement of the nozzle 30 has its axis not parallel to the bank direction of wire turns and, therefore, causes a change in feeding rate of the wire 29 while the nozzle 30 moves from a position A to a position B, resulting in unevenness of the winding tension of wire turns on the coil bobbin.

In short, the conventional bank winding methods applied for manufacturing an engine ignition coil device has the following problems to be solved.

The first problem of the conventional bank winding method for axially winding a wire in banks of turns at a bank angle on a coil bobbin is that it is necessary to provide a sufficiently thick layer of insulating resin filled around the secondary coil to secure its dielectric strength according to potential distribution over the secondary coil wound on the coil bobbin.

This may present a particular severe condition for an open-magnetic-circuit-type engine igniting coil device which comprises a cylindrical coil case containing an ignition coil assembly integrally molded therein by potting with melted insulating resin and which is directly attached at its terminal to an ignition plug mounted in a cylindrical bore in a cylinder head portion of a vehicle engine. Namely, the ignition coil device must have a coil case of a diameter that is large enough to enclose the secondary coil of the assembly with a thick layer of insulating resin for assuring a sufficient dielectric strength.

The second problem is that a secondary coil formed on a coil bobbin 8', as shown in FIG. 8, by winding a wire 71 around a shaft of the coil bobbin 8' at a bank angle θ may be deformed due to a slip-down of banks of wire turns therein during and even after bank winding. Such slip-down in the secondary coil may result from the fact that several initial banks of wire turns could not be placed correctly at a given bank angle θ around the coil bobbin from the flanged portion thereof. A slip-down of any layer in the secondary coil causes an increase of a voltage between the layers of wire turns, resulting in a breakage of the interlayer insulation of the secondary coil.

The third problem is that the reciprocal movement of the wire feeding nozzle along an axis not parallel to an axis of bank direction causes a change in the feeding rate of the wire, i.e., a change of tension of the wire being wound during the nozzle movement, resulting in slip-down of the wire layers in the coil. Consequently, the thus formed secondary coil can not assure a constant dielectric strength of its interlayer insulation.

SUMMARY OF THE INVENTION

In view of the foregoing, it is an object of the present invention to provide an engine igniting coil device of a small size, which comprises a coil case containing therein an ignition coil assembly composed of a secondary coil bobbin having a secondary coil wound thereon, a primary coil bobbin having a primary coil wound thereon and coaxially being inserted in the secondary coil bobbin, a core inserted in a hollow center of the primary coil bobbin and which coil case with the internal assembly mounted therein is potted with melted insulating resin to form a single solid device, wherein the secondary coil bobbin used therein is formed by winding an element wire in an axial direction around the coil bobbin at an angle in such a way that the coil may have a diameter decreasing in the winding direction to allow an insulation resin layer to reduce its thickness according to the potential distribution of the wound secondary coil.

Another object of the present invention is to provide an engine igniting coil device of a small size, which comprises a coil case containing therein an ignition coil assembly composed of a secondary coil bobbin having a secondary coil wound thereon, a primary coil bobbin having a primary coil wound thereon and coaxially being inserted in the secondary coil bobbin, a core inserted in a hollow center of the primary coil bobbin and which coil case with the internal assembly mounted therein is potted with melted insulating resin to form a single solid device, wherein the secondary coil bobbin used therein is formed by winding an element wire in an axial direction around the coil bobbin at an angle by placing wire turns in grooves continuously formed on the shaft of the secondary coil bobbin, each of which grooves can accommodate not more than six turns of the wire in an optimal condition to prevent the wire turns from slipping down in the axial winding direction. In addition, the secondary bobbin has a slop flanged portion where bank winding begins and which slope corresponds to a bank winding angle, which is useful for reliably placing layers of wire turns in good order on the secondary bobbin from the beginning of bank winding.

Another object of the present invention is to provide an improved bank winding method of forming a secondary coil on a secondary coil bobbin for an engine igniting coil device of the above mentioned type, by which an element wire being fed from a nozzle head, which head reciprocally moves a specified distance along an axis being parallel to an angle of the bank winding, is wound in layers of wire turns one by one at a specified bank-winding angle on the coil bobbin which rotates about its axis and, at the same time, moves in the axial direction, whereby the reciprocal movement of the nozzle is parallel to the angle of the bank winding that assures a constant feeding rate of the wire and a constant tension of the wire, thereby forming a reliable secondary coil on the secondary coil bobbin.

DESCRIPTION OF THE PREFERRED EMBODIMENTS

The preferred embodiments of the present invention will now be described in detail by way of example and with reference to the accompanying drawings.

Figure 1:
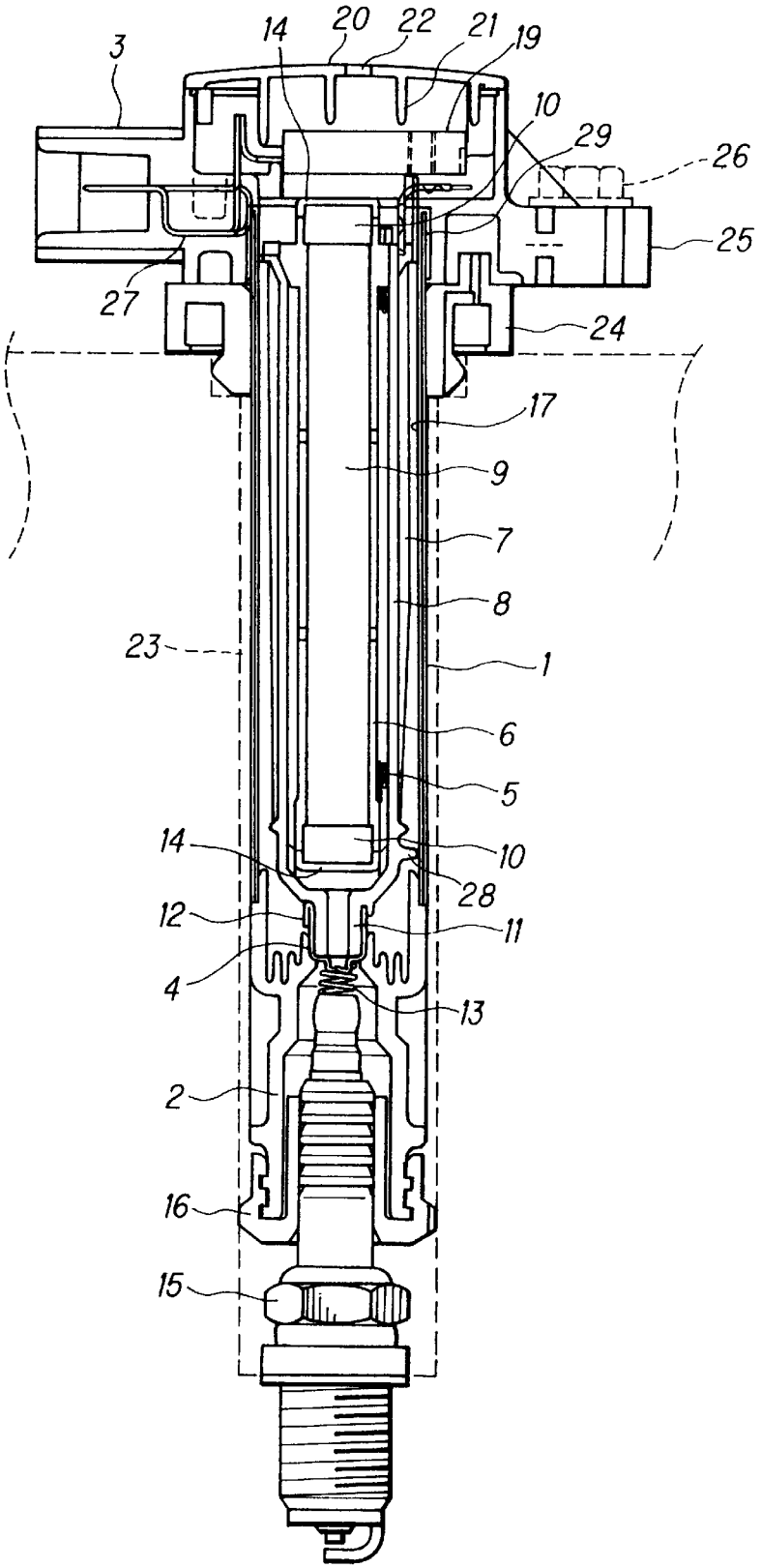
FIG. 1 is a vertical sectional view of an engine igniting coil device embodying the present invention.

FIG. 1 shows an open-magnetic-circuit-type engine igniting coil device which is designed to be mounted in a cylindrical bore in a cylinder head of a vehicle engine, with its terminal directly attached to an ignition plug of the engine.

The engine ignition coil device comprises a coil case 1, an ignition coil assembly mounted in the case 1, a plug cover 2 fitted in an open bottom end of the case 1 and a low-voltage-terminal socket 3 containing an igniter therein and being externally fitted on an upper open end of the case 1.

The coil case 1 accommodates the ignition coil assembly of a coil bobbin 6 with a primary coil 5 having a hollow center with a rode-shape core 9 inserted therein and a coil bobbin 8 with a secondary coil 7 coaxially mounted on the coil bobbin 6. The core 9 is provided at each end with a permanent magnet 10 for obtaining a large change in magnetic flux with an interrupted primary current.

Figure 2:
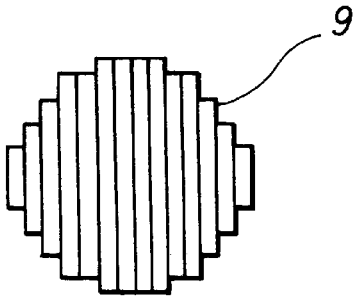
FIG. 2 is a plan view of a core of the engine igniting coil device shown in FIG. 1.

As shown in FIG. 2, the core 9 is composed of laminations of iron plates having different widths with a stepped nearly circular section so that a magnetic flux may be effectively produced by increasing its space factor in the hollow center of the cylindrical coil bobbin 6.

A high-voltage terminal holder 11 is a center projection formed integrally with the flanged end portion of the secondary coil bobbin 8. A high-voltage terminal 12 bonded to the holder 11 has a spring contact 13 attached thereto for providing electrical connection with an ignition plug 15.

The assembly of the primary coil bobbin 6, secondary coil bobbin 8, high-voltage terminal 12 and spring contact 13 is mounted at a given place and fixed in the coil case in such a manner that a holder portion of the high-voltage terminal 12 is press-fitted in the small tubular hole 4 of the coil case 1 and the spring contact 13 projects outwardly from the small tubular hole 4.

The coil case 1 with the assembly fixed at the given place therein is filled with melted insulating resin injected through a hole 22 made in the cap 20 of the low-voltage socket 3 to form a single solid device. The permanent magnets 10 attached one to each end of the core 9 are covered with damping members 14, respectively, which can prevent intrusion of melted resin into the core 9 and absorb relatively large thermal stress produced in the longitudinal direction of the core 9, thus preventing cracking of the resin layer formed round the core 9.

The coil case 1 is made of dielectomagnetic material having a high permeability (e.g., silicone steel) and is grounded through an electrical connection between the coil case 1 and a grounding terminal 27 in the low-voltage terminal socket 3.

Thus, the coil case 1 has an electromagnetic shielding effect and acts as a side core for concentrating a larger portion of magnetic flux produced by the open-magnetic-circuit type ignition coil assembly to the case 1, thus preventing loss of the produced magnetic flux by passing through a cylinder block of the engine to cause a drop of a secondary output voltage.

Because the coil case 1 is maintained at the ground potential level, one is protected against an electrical shock by a discharge of leakage current from any internal high potential portion of the case 1. Furthermore, occurrence of a local corona discharge between the secondary coil 7 and the coil case 1 can be effectively prevented. This improves the durability of the insulating resin layer formed therebetween.

Figure 4:
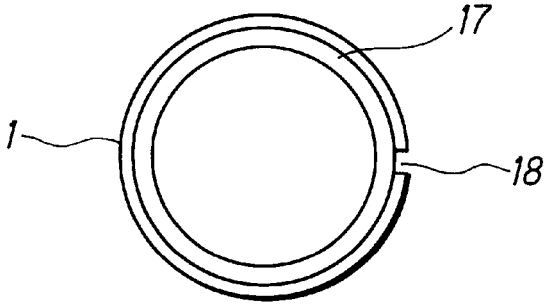
FIG. 4 is an end view of a coil case of the engine igniting coil device shown in FIG. 1.

The tight connection of the coil case 1 with the cylinder head of the vehicle engine eliminates the possibility of occurrence of electric discharge therebetween, thus improving the performance of the control system of the engine and peripheral devices. As shown in FIG. 4, the coil case 1 has a slit 18 to form a gap of 0.5 to 1.5 mm in longitudinal direction and a C-shaped section to minimize an eddy current loss.

The coil case 1 is internally covered with an elastic member 17 such as rubber and elastomer. This elastic member 17 separates the resin layer from the inner wall of the coil case 1 and absorbs any thermal stress of the metal, thus preventing the resin layer from cracking.

The plug cover 2 is provided at its end with a plug rubber 16 which holds an ignition plug 15 and serves as a locator for inserting the coil case in the cylindrical bore 23. It can also absorb vibration transmitted from the engine. The ignition plug 15 is inserted into the plug rubber 16 wherein its tip makes contact with the spring contact 13 for creating the electrical connection of the ignition coil device with the ignition plug 15 of the engine.

The low-voltage-terminal socket 3 contains an igniter 19. The socket 3 is fitted on an outwardly bent or folded portion 29 of the elastic member 17 provided on the inside wall of the case 1 to assure a high sealing quality.

Figure 3:
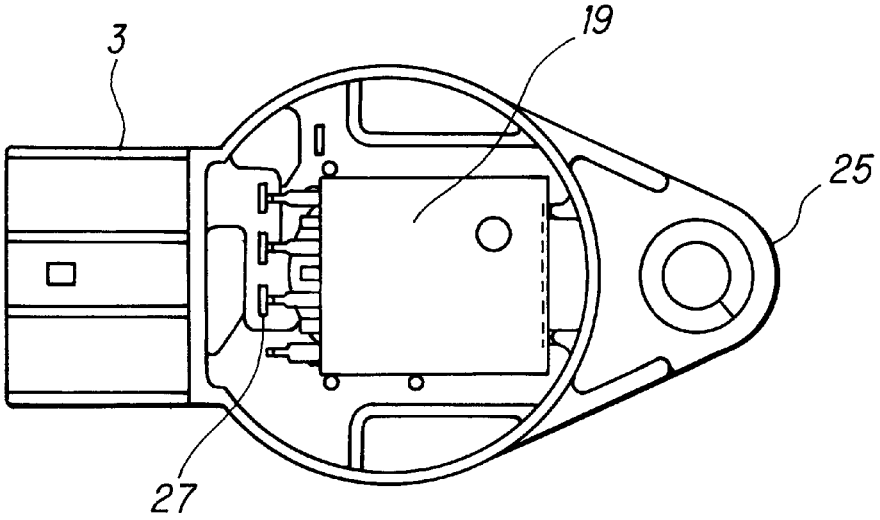
FIG. 3 is a plan view of the engine igniting coil device of FIG. 1 with a cap of a low voltage terminal removed.

FIG. 3 shows an internal structure of the low-voltage-terminal socket 3 with the cap 20 removed.

Melted resin is poured by using an injection nozzle into the low-voltage terminal socket 3 through a port 22 in the cap 20 mounted thereon until tips of ribs 21 formed on the inside wall of the cap 20 are immersed in liquid resin. Thus, the cap 20 is integrally fixed on the low-voltage-terminal socket. The ribs 21 of the cap 20 serve as a cushion for dispersing thermal stress to the resin layer, thus preventing cracking of the resin layer on the igniter 19.

The coil case 1 has a seal rubber 24 fitted on its external wall under the low-voltage terminal socket 3. This sealing rubber tightly seals the open end of the cylindrical bore 23 in the cylinder head of the vehicle engine when the coil case 1 is inserted into the cylindrical bore 23 of the cylinder head.

With the coil case 1 mounted in the cylindrical bore 23, this ignition coil device is secured to the cylinder head with a bolt 26 in a flange 25 integrally formed with low-voltage terminal socket 3.

When the ignition coil device is secured with the bolt 26 to the cylinder head of the vehicle engine, the largest longitudinal thermal expansion of the device can be absorbed by the outwardly folded or bent portion 29 of the elastic member 17 provided inside the coil case 1.

Figure 5:
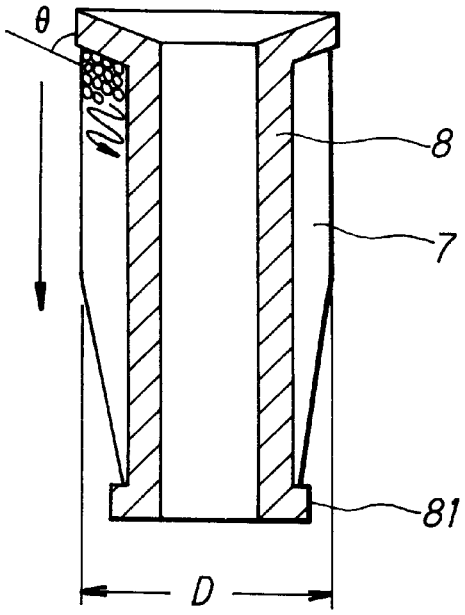
FIG. 5 is a vertical sectional view of a coil bobbin with a secondary coil wound thereon by bank winding by forming an external slope according to one embodiment of the present invention.

Referring now to FIG. 5, a method of winding secondary coil of the above-mentioned engine ignition coil device according to the present invention will be described.

As shown in FIG. 5, a secondary coil 7 is formed on a coil bobbin 8 by winding a wire axially in layers of turns (i.e., in banks) one by one at an angle θ (e.g., 25°) round the coil bobbin 7 while reducing the number of turns in a layer one by one to form a slope of coil (gradually reducing its diameter D) in the winding direction (as shown by an arrow in FIG. 5).

In the shown case, the coil 7 is formed on the coil bobbin 7 first by bank winding only to the midway and then by bank and slope winding.

The use of the bank winding method eliminates the necessity of providing a coil bobbin with ribs having a comb-like section for securing the dielectric strength of the coil to be formed thereon by split winding. Therefore, the secondary coil 7 can be formed on a coil bobbin of a reduced size, assuring the necessary dielectric strength of insulation of the coil.

In addition to this, using the slope winding method can form a secondary coil whose form is suited to be insulated by an insulating resin layer filled between the coil case 1 and the secondary coil according to according to the potential distribution in the secondary coil in the winding direction thereof. Consequently, the necessary insulating resin layer formed round the secondary coil may have a reduced thickness and the coil case 1 accommodating the thus formed coil assembly may have a reduced diameter, thus realizing a very compact ignition coil device.

The slope winding of the secondary coil 7 may be done on the coil bobbin 8 having a reduced-size end-flange 81 on the high-voltage side or no flange thereof.

Consequently, there may be a sufficient gap between the coil case 1 and the end-flange 81 of the secondary coil bobbin 8, at which the high-voltage-side secondary coil 7 terminates. This eliminates the possibility of leakage through the flange along the inner wall of the coil case 1. Thus, the flange 81 itself may not be subjected to cracking due to thermal shrinkage.

The secondary coil bobbin 8 has a plurality of protrusions 28 (see FIG. 1) formed thereon apart from the end flange 81. With the ignition coil assembly mounted in the coil case 1, these protrusions 28 of the coil bobbin 8 can abut the inner wall of the coil case, thus centering the assembly therein.

The arrangement of the protrusions 28 on the coil bobbin 8 are enough apart from the high-voltage portion of the secondary coil formed on the bobbin 8 not to allow leakage therefrom along the inner wall of the coil case 1.

Figure 6:
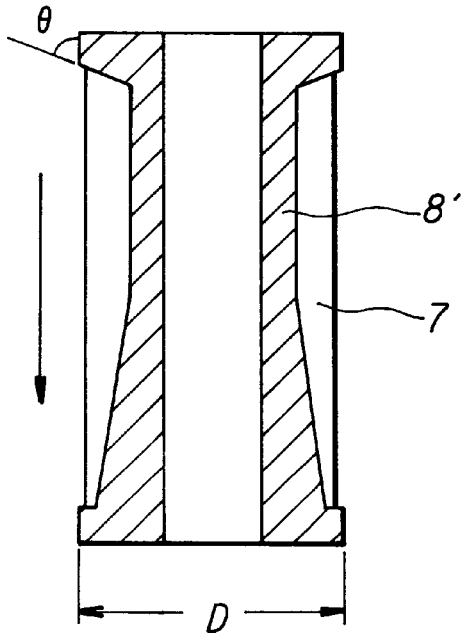
FIG. 6 is a vertical sectional view of a coil bobbin with a secondary coil wound thereon by bank winding by forming an internal slope according to another embodiment of the present invention.

FIG. 6 illustrates an embodiment where a coil 7 is formed on a coil bobbin 8' of a diameter increasing in the winding direction by a so-called inward-slope winding method. This method is effective to prevent slip-down of the coil turns in comparison with a so-called outward-slope winding method shown in FIG. 5.

Figure 7:
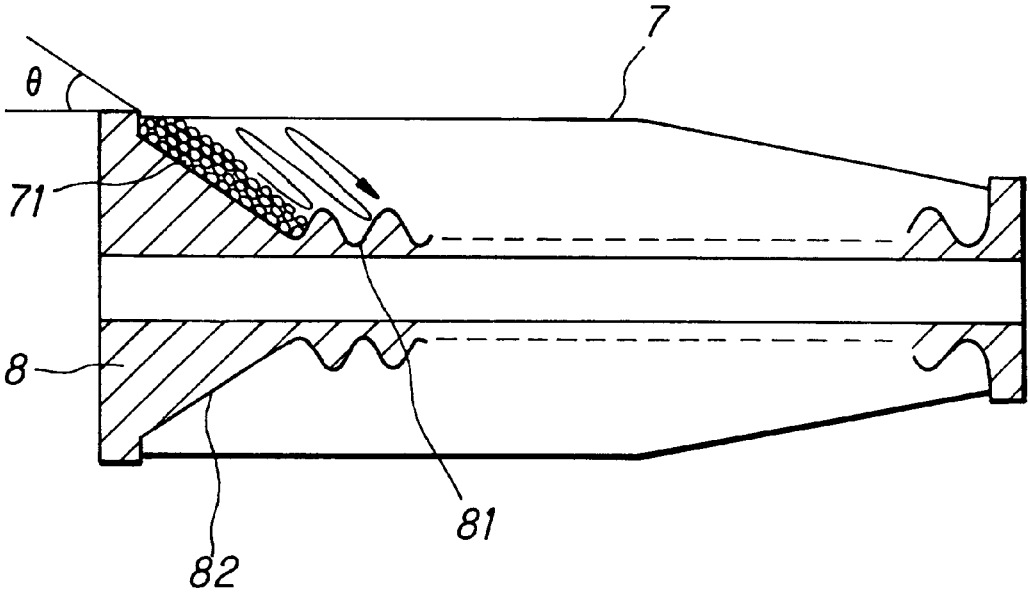
FIG. 7 is a longitudinal sectional view of a coil bobbin with a secondary coil wound thereon by a bank winding method according to another embodiment of the present invention.
Figure 8:
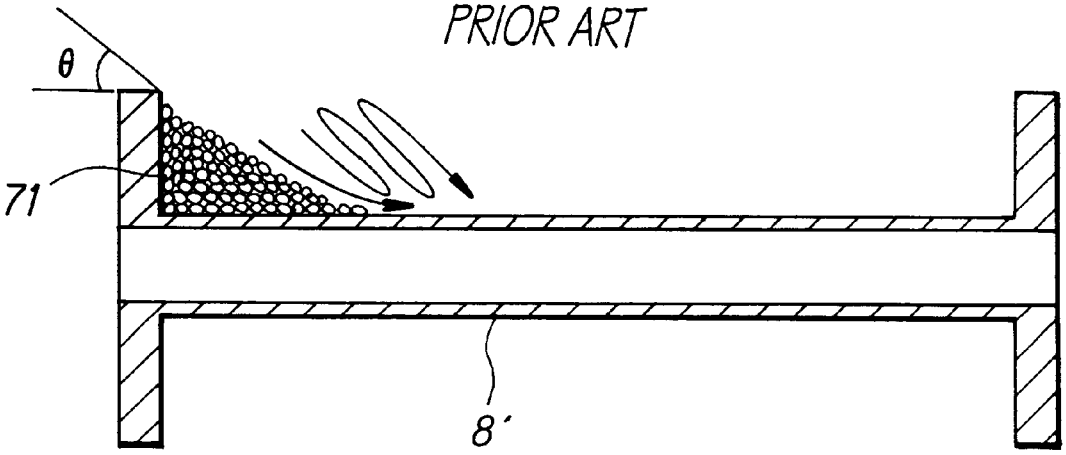
FIG. 8 PRIOR ART
FIG. 8 is a longitudinal sectional view of a coil bobbin with a secondary coil wound by a conventional bank winding method.

The present invention also provides a method shown in FIG. 7 of forming a secondary coil 7 of an ignition coil device by bank winding on a coil bobbin 8 whose body has a plurality of annular grooves 81 continuously provided along the axial direction for accommodating not more than 6 turns of a coil wire 71 in each groove 81. This method can effectively prevent the slip-down of wire turns while winding the coil wire in layers of turns.

For example, the coil bobbin 8 for winding thereon an element wire 71 of 0.05 mm in diameter shall have a groove 81 of 0.1 to 0.2 mm in depth and 0.1 to 0.5 mm in width. An ideal size of the groove 81 is such to accommodate a single turn of the wire 71. However, such a fine groove is difficult to cut on the coil bobbin. The size of groove 81 to be easily formed in practice on the coil bobbin 8 is only by way of example shown and described above.

An excessive large-sized groove shall be, however, avoided because such a groove may accommodate a number of wire turns 71 in disorder, resulting in a breakage of insulation of the coil wire laid therein due to an increased line voltage.

Accordingly, the prevent applicant has previously determined by experiments the firing potential of a wire 71 to be coiled and, on the basis of the experiment results, has set the preferred size of a groove 81 to be cut on the coil bobbin body by volume for accommodating no more than 6 turns of the wire therein for preventing the slip-down of wire turns in the coil.

According to the present invention, a bank 82 corresponding to a bank-winding angle θ (FIG. 7) is formed on a flanged portion of a coil bobbin 8 where winding of the wire 71 starts.

In bank-winding of a secondary coil 7, the wire 71 can be wound in layers of turns in order at a specified angle θ from a start point on the flanged portion of the coil bobbin 8 without causing slip-down of wire turns.

Figure 9:
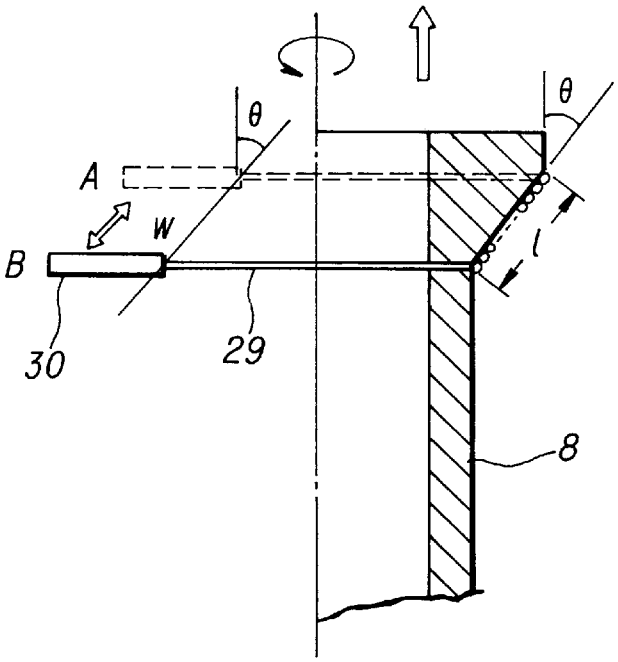
FIG. 9 is a view showing a relation between a wire feeding nozzle and a bank angle of a coil wound on a coil bobbin by a bank winding method according to another embodiment of the present invention.
Figure 10:
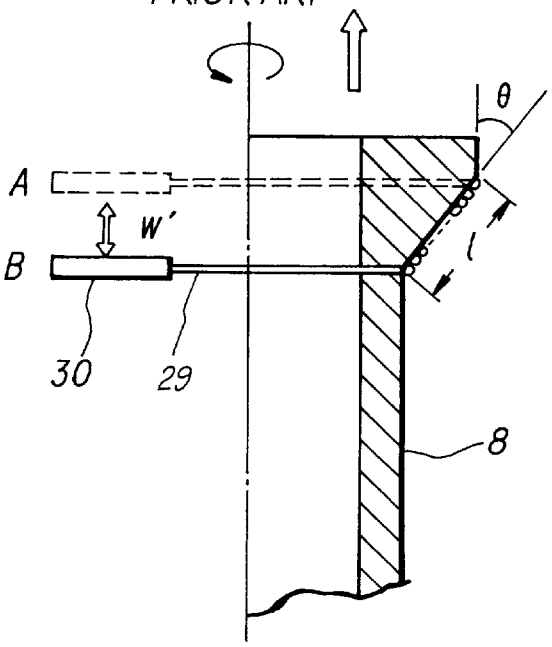
FIG. 10 PRIOR ART
FIG. 10 is a view showing a relation between a wire feeding nozzle and a bank angle of a coil wound on a coil bobbin according to a conventional bank winding method.

According to an aspect of the present invention, as shown in FIG. 9, a bank winding method is adopted for forming a secondary coil on a secondary coil bobbin for an engine igniting coil device, by which an element wire 29 being fed from a nozzle 30, which reciprocally moves a specified distance (w) corresponding to a bank length (l) along an axis parallel to an angle of the bank winding, is wound in layers of wire turns one by one at a specified bank-winding angle θ on the coil bobbin 8 which rotates about its axis and, at the same time, moves in the direction as shown at an angle θ from the axis of the bobbin 8.

The reciprocal movement of the nozzle 30 being parallel to the angle of the bank winding at the angle θ does not cause a change in feeding rate of the wire 29 and, therefore, a change in tension of the wire 29 while the nozzle 30 travels from Position A to Position B. Namely, the wire can be fed a constant rate (without being affected by the reciprocal movement of the nozzle 30) and be wound at a constant tension on the coil bobbin 7 by the bank-winding method to form a reliable secondary coil 7 on the secondary coil bobbin 8. As described above, the present invention provides an engine ignition coil device that has the following improvements.

In an engine igniting coil device according to one aspect of the present invention, a secondary coil unit used therein is formed by bank and slope winding of an element wire in an axial direction around the coil bobbin at an angle in such a way that the coil may have a diameter decreasing in the winding direction. This allows the dielectric strength of the secondary coil to be set at a lower level and allows the reduction of thickness of an insulation resin layer formed around the secondary coil in thickness according to the potential distribution of the wound secondary coil, enabling the whole ignition coil device to be compact.

In an engine igniting coil device according to another aspect of the present invention, a secondary coil bobbin used therein is formed by winding an element wire in an axial direction around the coil bobbin at an angle by placing wire turns in a grooves formed on the secondary coil bobbin which can accommodate not more than six turns of the wire in an optimal condition to prevent the wire turns from slipping down in the axial winding direction with no fear of breakage of the insulation of the coil wire turns in the groove.

In addition, the secondary bobbin has a bank formed on a flanged portion where the bank winding begins and the slope of which corresponds to a bank winding angle. This is useful for reliably placing layers of wire turns in good order on the secondary coil bobbin from the beginning of the bank winding.

Furthermore, a winding method of forming an ignition coil whereby an element wire being fed from a nozzle head which reciprocally moves a specified distance along an axis being parallel to an angle of the bank winding, is wound in layers of wire turns one by one at a specified angle of the bank winding on the coil bobbin which rotates about its axis and, at the same time, moves in the axial direction, wherein the reciprocal movement of the nozzle is parallel to the angle of the bank winding which assures a constant feeding rate of the wire and a constant tension of the wire, forming a reliable secondary coil on the secondary coil bobbin.

We claim:

1. An engine igniting coil device which has a coil case containing an internal assembly consisting of a secondary coil bobbin having a secondary coil wound thereon, a primary coil bobbin having a primary coil wound thereon and coaxially mounted in the secondary coil bobbin and a core inserted in a hollow center of the primary coil bobbin, said coil case and said internal assembly therein are integrally formed with each other by filling the coil case with melted insulating resin, wherein the secondary coil bobbin has the secondary coil formed thereon by bank winding an element wire in layers of wire turns one over another at a specified bank angle in an axial direction on the secondary coil bobbin and by sequentially reducing the number of layers of wire turns in an end portion in the direction of winding to form a tapering wire end portion with a reducing wire thickness.

2. An engine igniting coil device as defined in claim 1, characterized in that the secondary coil wound on the secondary coil bobbin has a tapered end whose diameter is smaller than a diameter of an end-flange portion of the secondary coil bobbin.

3. An engine igniting coil device as defined in claim 1, characterized in that the secondary coil bobbin has no flange at one end where winding terminates.

4. An engine igniting coil device as defined in claim 1, characterized in that the secondary coil bobbin has an outwardly tapered end whose diameter is larger than a diameter of the flanged portion wherefrom the winding bank starts on the secondary coil bobbin.

5. An engine igniting coil device as defined in claim 4, characterized in that the secondary coil winding has a constant outer diameter from one end to the other.

6. An engine igniting coil device which has a coil case containing an internal assembly consisting of a secondary coil bobbin having a secondary coil wound thereon, a primary coil bobbin having a primary coil wound thereon and coaxially mounted in the secondary coil bobbin and a core inserted in a hollow center of the primary coil bobbin, said coil case and said internal assembly therein are integrally formed with each other by filling the coil case with melted insulating resin, wherein the secondary coil bobbin has the secondary coil formed thereon by bank winding an element wire in layers of wire turns one over another at a specified bank angle in an axial direction on the secondary coil bobbin which has grooves continuously formed thereon, each said groove accommodating at least two and not more than six turns of the wire.

* * * * *